US005513697A

United States Patent [19]

Gudmundsson

[11] Patent Number: 5,513,697

[45] Date of Patent: May 7, 1996

[54] METHOD AND DEVICE FOR TRANSFER OF HEAT

[76] Inventor: Bjorn Gudmundsson, Porsvagen 120, Sollentuna, Sweden, S-191 48

[21] Appl. No.: 460,757

[22] Filed: Jun. 2, 1995

Related U.S. Application Data

[62] Division of Ser. No. 137,040, Oct. 18, 1993, abandoned.

[30] Foreign Application Priority Data

Apr. 17, 1991 [SE] Sweden ..... 9101169
Apr. 16, 1992 [WO] WIPO ..... PCT/SE92/00254

[51] Int. Cl.[6] ..... F28D 11/02

[52] U.S. Cl. ..... 165/88; 165/165; 165/120

[58] Field of Search ..... 165/86, 88, 92, 165/120, 121, 122, 164, 165

[56] References Cited

U.S. PATENT DOCUMENTS

| | | | |
|---|---|---|---|
| 2,402,304 | 6/1946 | Vannerus | 165/88 |
| 2,596,622 | 5/1952 | Vannerus | 165/88 |
| 3,092,180 | 6/1963 | Dahlgren | 165/88 |
| 3,221,807 | 12/1965 | Johansson | 165/88 |
| 3,430,690 | 3/1969 | Sciaux | 165/88 |
| 3,650,319 | 3/1972 | Boon | 165/88 |
| 3,844,341 | 10/1974 | Bimshas, Jr. et al. | 165/86 |
| 4,044,824 | 8/1977 | Eskeli | 165/88 |
| 4,627,890 | 12/1986 | Porter et al. | 165/88 X |
| 4,640,345 | 2/1987 | Nishimura | 165/92 |
| 4,731,159 | 3/1988 | Porter et al. | 165/88 X |

FOREIGN PATENT DOCUMENTS

| | | |
|---|---|---|
| 3608797 | 10/1987 | Germany . |
| 47996 | 6/1915 | Sweden . |
| 590443 | 8/1977 | Switzerland . |
| 936059 | 9/1963 | United Kingdom . |

OTHER PUBLICATIONS

Mochizuki, S. "Performance Evaluation on Rotating Disk Assemblies by Automated Transient Testing Method" *Heat and Technology*, vol. 4, No. 2, 1986, pp. 1–21.

*Primary Examiner*—Leonard R. Leo
*Attorney, Agent, or Firm*—Dowell & Dowell

[57] ABSTRACT

A method and apparatus for the transfer of heat with the aid of rotating surfaces. The fluid with which an exchange or transfer is to be made is introduced in parallel in one or more gaps or channels defined between the rotating surfaces. Rotation of the surfaces causes the major part of the fluid flow to pass through a rotating, flow mechanical boundary layer adjacent the rotating transfer surface in lamellar or turbulent flow.

18 Claims, 4 Drawing Sheets

METHOD AND DEVICE FOR TRANSFER OF HEAT

CROSS REFERENCE TO RELATED APPLICATIONS

This application is a divisional application Ser. No. 08/137,040 filed Oct. 18, 1993, abandoned, and entitled Method and Device for Transfer of Heat or Mass.

BACKGROUND OF THE INVENTION

1. Field of the Invention

The present invention relates to a method of transferring heat with the aid of rotating surfaces. The invention also relates to apparatus for carrying out the method.

2. History of Related Art

It is known to improve the transfer of heat between a fluid and a surface, by disturbing the flow adjacent the surface, this being achieved in the case of so-called flat plate-type heat exchangers by corrugating the transfer surfaces or by providing these surfaces with turbulence-generating means.

Although this will disturb or agitate the flow of medium adjacent the surfaces, it does not induce the fluid to flow adjacent to or contiguously with the surfaces, which would improve heat transfer, but instead the fluid remains in a stationary layer close to the heat transfer surfaces, this layer having an insulating effect on the heat transfer process.

Another method of improving heat transfer is to allow the fluid to flow through narrow confined passageways, such as in the case of rotating heat-exchangers, wherein the short distance between the fluid and the wall is utilized in an endeavor to improve heat transfer. One drawback with this solution is that the major part of the fluid passes through the center of the passageway or channel, despite the narrowness of the passageway, and thus plays a smaller role in the heat transfer process. Another drawback is that the narrow passageways are liable to become blocked, and it is often necessary to take measures to prevent blocking of the passageways, therewith making the system more expensive. In the two cases described above, the measures taken to improve heat or mass transfer involve attempting to force into being an effect which is opposed to the intrinsic will of the fluid flow to flow in a certain manner.

U.S. Pat. No. 4,044,824 teaches a method of exchanging heat between two fluid flows which are conducted in heat-exchange relationship with one another in a rotating heat exchanger having fluid-accommodating bellows-like pockets. The differences in the density occurring between the fluid to be cooled and the fluid to be heated is utilized to create turbulent conditions that are intended to promote the exchange of heat and the transportation of the fluids. One drawback with this known arrangement, however, is that the entire fluid flow is passed through one and the same channel out of and into the bellows-like pockets, which limits the capacity of the heat-exchanger and impairs its ability to transfer heat, since the major part of the fluid flow passes through the center of the channel or passageway, as described above.

GB-A-936,059 teaches a heat-exchange method and a heat-exchanger which is comprised of an outer element, an inner element and an intermediate element of bellows-like form, these three elements defining therebetween two channels for the pass through of media between which an exchange of heat takes place. This method and the illustrated heat-exchanger have the drawbacks mentioned above with respect to the aforesaid U.S. patent.

SUMMARY OF THE INVENTION

Distinct from the aforedescribed known methods and apparatus, the main object of the invention is to provide a method for heat transfer in which the transfer index or number is improved by utilizing the natural phenomenon of flow mechanics, without disturbing the fluid flow or forcing unnatural motion onto the flow. On the basis of this object, there is proposed a method for heat transfer in which very high transfer indexes or numbers are achieved.

Another object of the invention is to provide a heat transfer method in which the transfer performance can be adjusted readily to desired values.

A further object of the invention is to provide a heat transfer apparatus which is compact in relation to the transfer numbers or indexes obtained, since the heat transfer is contingent on factors other than the size of the transfer surface.

These and other objects are achieved with the method and the apparatus having the characteristic features set forth in the following Claims.

BRIEF DESCRIPTION OF THE DRAWINGS

The invention will now be described in more detail with reference to a number of exemplifying embodiments thereof and also with reference to the accompanying drawings, in which.

DESCRIPTION OF THE PREFERRED EMBODIMENT

Figure 1:
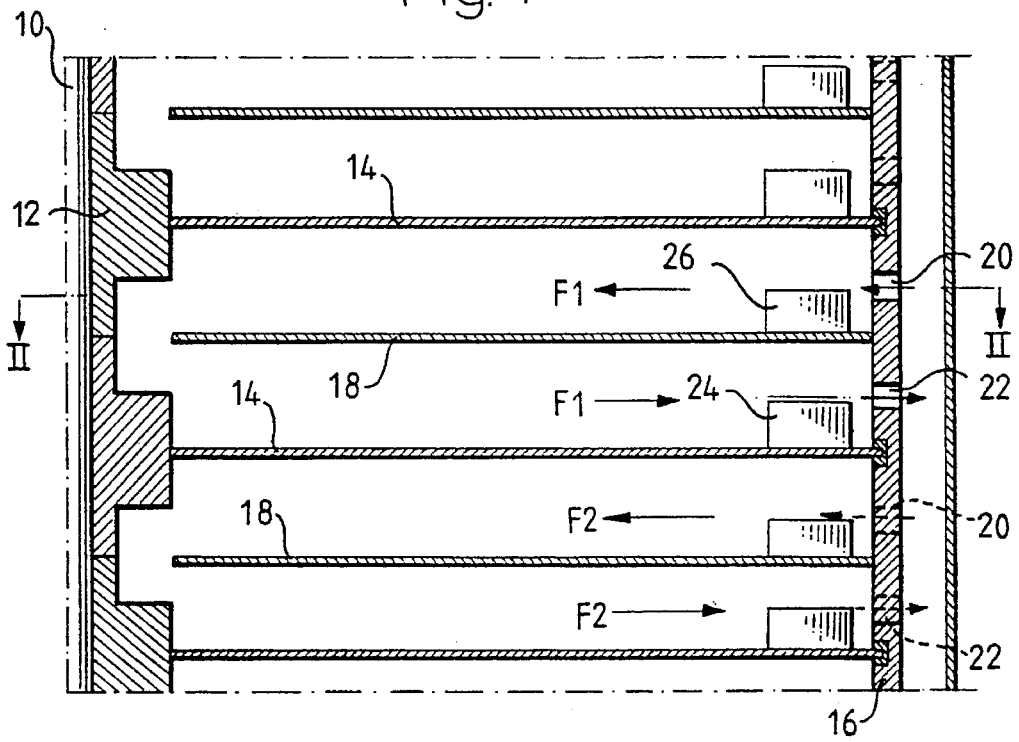
FIG. 1 is a sectional view of an apparatus for carrying out the method of the present invention.

The apparatus illustrated in FIG. 1 comprises a number of flat discs which are mounted on a rotation shaft 10 by means of sleeves 12 and which are intended to rotate together with the shaft 10 at appropriate speeds. The shaft 10 and the discs 14 rotate in a cylindrical housing whose outer wall 16 supports a number of planar discs 18 which are attached to the outer wall and which project in between the first mentioned discs 14 and terminate short of the shaft 10, so as to form an interspace between the ends of the discs 18 and the shaft 10. The free edges of the discs 14 mounted on the shaft 10 and fitted to the sleeves 12 extend into a respective recess provided in the wall 16. Arranged in the recess are labyrinth seals or, with regard to fluid seals, axial seals or the like for instance, which ensure that no leakage will occur between the discs 14 and the wall 16. Arranged alternately in the wall 16 are inlets 20 and outlets 22 for delivery of a fluid to the channel or passageway defined between two discs 14 and an intermediate disc 18. It will be seen that the channel extends from the inlet 20 to a respective recess defined between the sleeves 12 and back to the outlet 22. When two mutually different fluids $F_1$ and $F_2$ are delivered to the channels, and exchange or transfer takes place between the fluids, for instance a heat transfer, without the fluids intermixing.

In the case of the FIG. 1 embodiment, the inlets 20 and the outlets 22 may be located alternately in the apparatus hub and the housing wall. This arrangement will produce a counterflow effect between the fluids in which an interchange shall take place on each surface of the discs 14, 18.

By rotating the discs 14, 18 at different speeds, for instance by rotating the shaft 10 and therewith also the discs 14, an extremely efficient transfer is obtained when the greatest radial velocity component of the fluid is located in a boundary layer close to the disc surface. This rotation also generates a disc pumping effect, which can be amplified, however, by providing the disc 14 with blades 24 or vanes of appropriate configuration and angular placement, while the disc 18 may be provided with guide vanes 26. Naturally, it is also conceivable to rotate the housing wall 16 and the discs 18; the discs 14 and 18, however, may be rotated either at mutually different speeds or at mutually the same speed.

Figure 2:
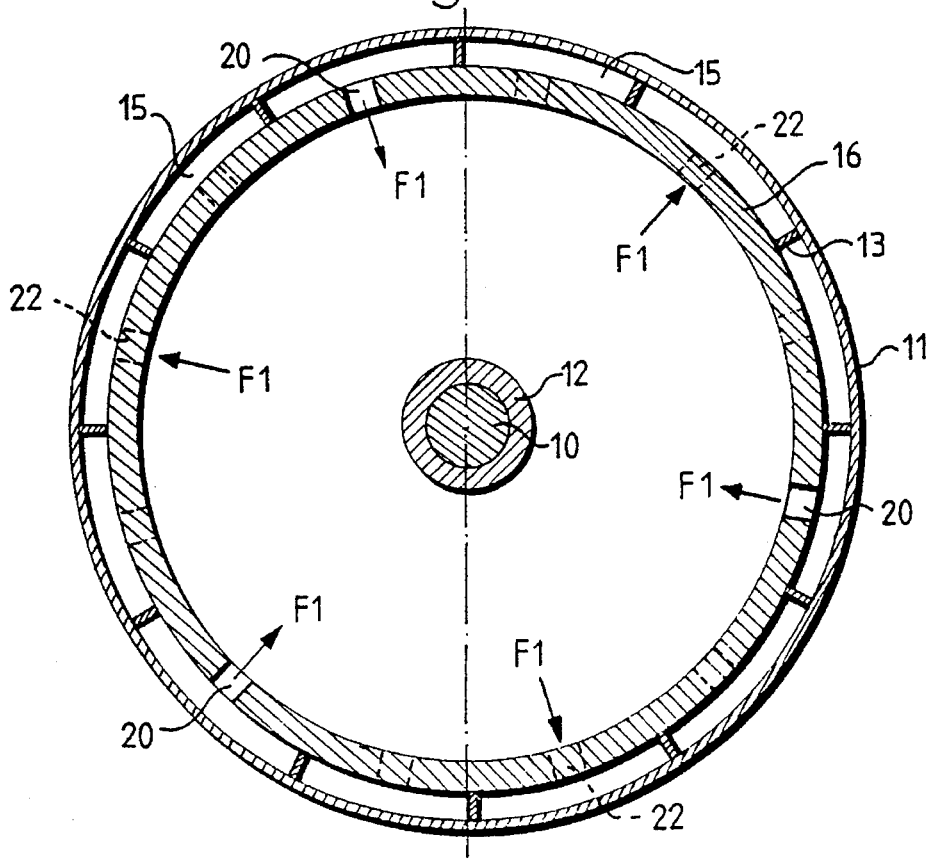
FIG. 2 is a sectional view of the apparatus shown in FIG. 1, taken on the line II—II.

FIG. 2 illustrates the delivery of the two fluids $F_1$ and $F_2$ to respective channels. Encircling the stationary housing 16 is a shell 11 which is divided by partition walls 13 into a number of riser channels 15 which form fluid inlets and outlets. In the case of the illustrated embodiment, three inlets 20 and three outlets 22 are connected with each disc-space between the discs 14, the inlets and outlets being uniformly distributed around the periphery of the apparatus so as to obtain an equal delivery of the fluid to the best possible extent. It will be understood that the number of inlets and outlets, and therewith the number of riser channels, can be varied as desired. FIG. 2 is a cross-sectional view through the entire apparatus, whereas FIG. 1 merely shows the right-hand half of the apparatus.

Figure 3:
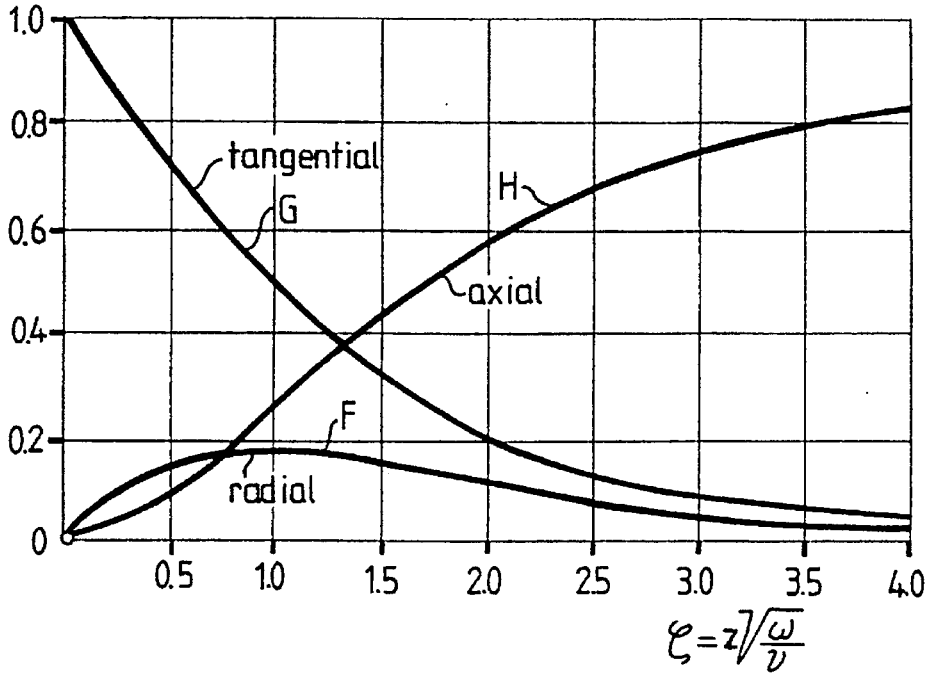
FIG. 3 illustrates the velocity distribution close to a disc which rotates in a stationary fluid.

FIG. 3 illustrates the flow mechanics of an infinite rotating disc in a fluid non-rotating far from the disc, and shows the velocity distribution close to the disc.

Figure 4:
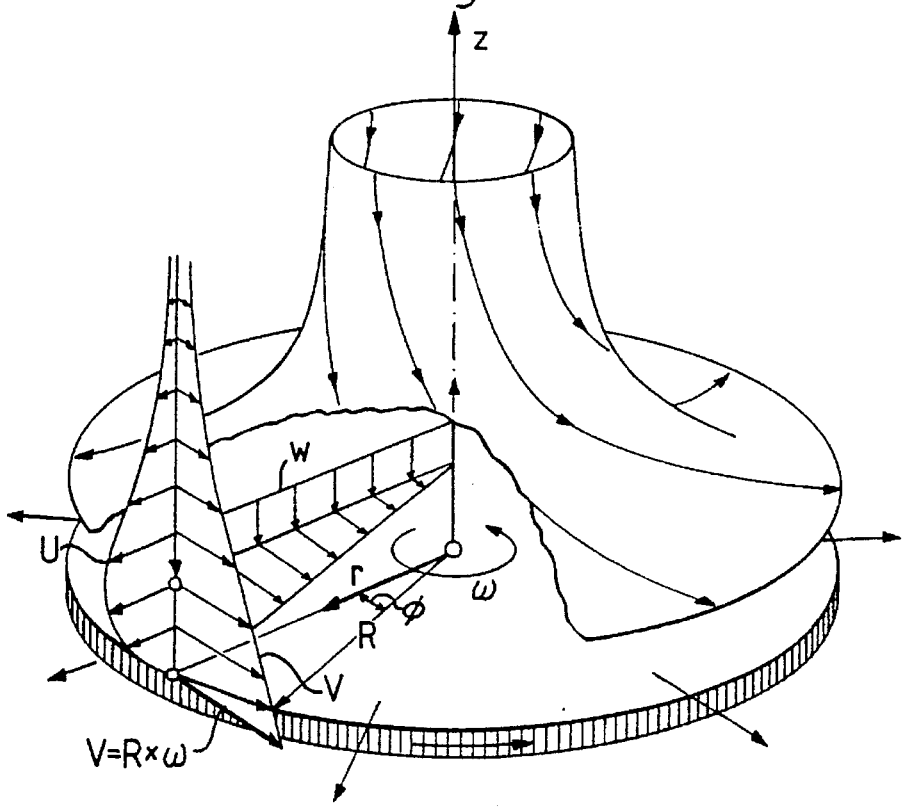
FIG. 4 illustrates a corresponding flow pattern of the disc when the fluid is delivered to the center or the disc.
Figure 5:
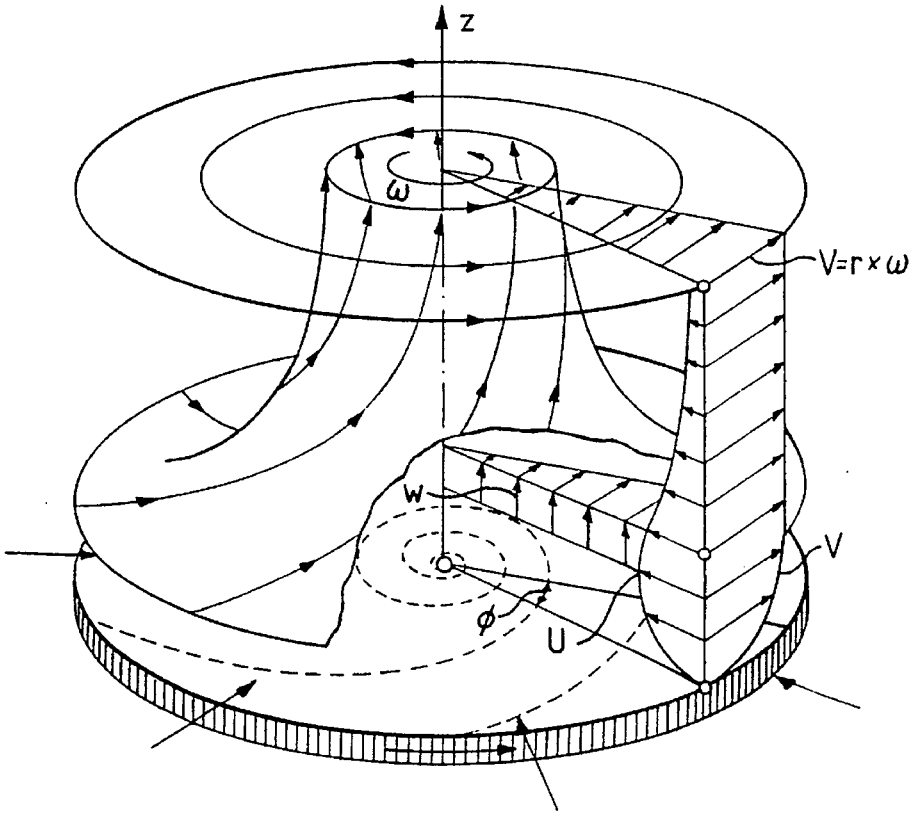
FIG. 5 illustrates a corresponding flow pattern when the fluid is delivered to the periphery of the disc with the fluid in full rotation.

The flow pattern, or flow field, has the appearance shown in FIGS. 4 and 5, wherein FIG. 4 illustrates the occurrence when the fluid is delivered to the center of the disc, while FIG. 5 is an illustration which shows the fluid delivered to the periphery of the disc with the fluid already in full rotation and flowing towards the center of the disc, similar to the embodiment shown in FIG. 1.

Figure 6:
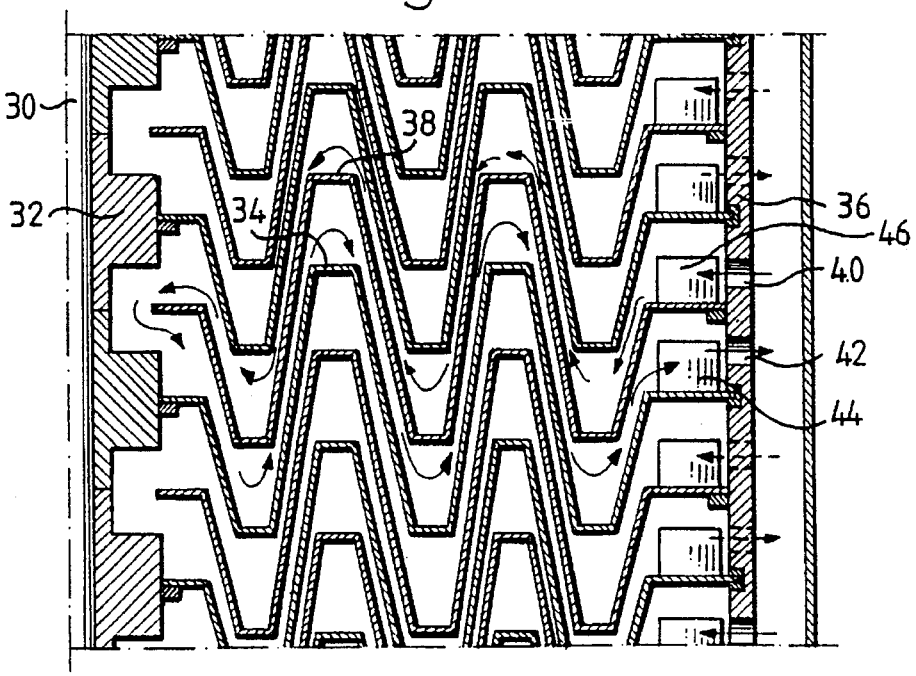
FIG. 6 is a vertical sectional view of another embodiment of the invention.

The embodiment illustrated in FIG. 6 comprises a shaft 30 on which sleeves 32 are mounted, these sleeves carrying plates 34 in a manner similar to that shown in FIG. 1, wherein the outer, free ends of the plates terminate against the wall 36 of a surrounding housing and are journalled in labyrinth seals, axial seals or other appropriate seals, as earlier described. Similarly, plates 38 are provided at the housing wall 36 and terminate short of the shaft 30 and the sleeves 32.

Distinct from the discs 14, 18 of the FIG. 1 embodiment, the plates 34, 38 are curved to form cylindrical surfaces which are generally vertical and between which there is formed a generally vertical channel for the two media which pass through respective channels. When the shaft 30 is rotated and therewith also the plates 34, a so-called Taylor flow will occur in the channel between the plates 34 and 38, i.e. vortices and turbulence are generated which cause the medium in the channel to move between the channel surfaces and therewith improve the transfer effect, e.g. the heat transfer effect, between the two mutually isolated flowing media. This effect is greatest when the plates 34 rotate and the plates 38 are stationary, although it is also conceivable for the wall 36 to rotate in relation to the shaft 30, wherein rotation may be effected at different speeds of the plates 34 and the plates 38, or at one and the same speed.

The embodiment illustrated in FIG. 6 also includes fluid inlets 40 and fluid outlets 42 and the plates 34, 38 may be provided with blades or vanes 44, 46 for guiding and pumping the media. Similar to the embodiment illustrated in FIG. 1, in inlets 40 and the outlets 42 may lie alternately in the apparatus hub and in the housing wall 36, so as to obtain a counterflow effect between the fluids flowing in the channels.

Figure 7:
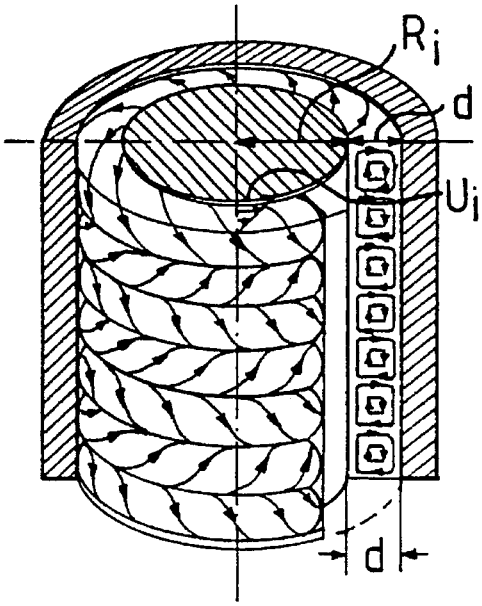
FIG. 7 illustrates schematically the principle of the embodiment illustrated in FIG. 6.
Figure 8:
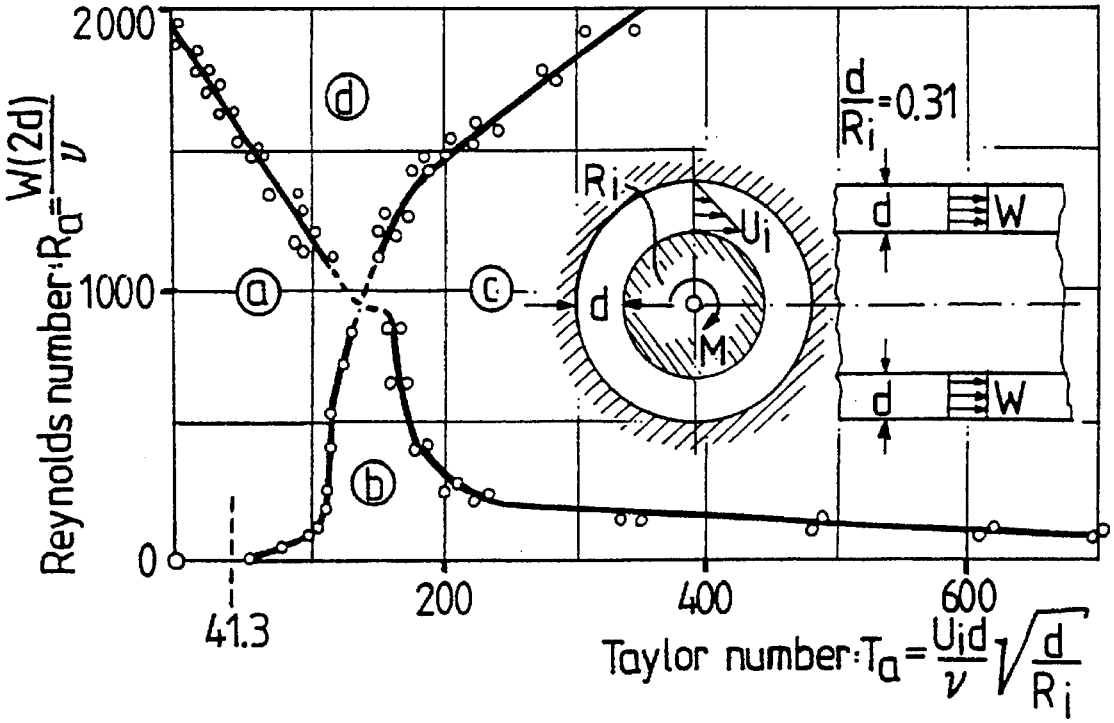
FIG. 8 is a diagram showing laminar and turbulent flow in the embodiment illustrated in FIG. 7.

In the embodiment illustrated in FIG. 6, so-called Taylor vortices or eddies are generated between the vertical parts of the plates 34, 38, in the manner shown in FIG. 7. According to the measurements, an axial net flow, which can be expressed by a Reynolds number, influences the circumstances for Taylor vortices, which can be expressed in a Taylor number in accordance wit the diagram shown in FIG. 7 where the Taylor number is plotted in relation to the Reynolds number. The best possible transfer number, or index, is located within the area b and c of the diagram.

All of the illustrated embodiments of the invention, i.e. embodiments having planar surfaces and rotating cylindrical surfaces, enable a more compact contact body to be produced whose transfer performance is achieved more by speed than by surface size. Because the flows are delivered in parallel, a large volumetric flow can be distributed over an appropriate number of discs to the extent permitted by the flow capacity of the boundary layer, so that the flow is adapted optimally, to the best possible effect, to provide the best transfer ability or transfer effect with the rotation-mechanical conditions that prevail.

It will also be obvious that the illustrated and described exemplifying embodiments of the invention do not limit the scope of the invention and that modifications and changes can be made within the scope of the following Claims.

I claim:

1. A method of effecting heat transfer between at least two flowing media with the aid of rotating surfaces rotating in a rotational direction, comprising introducing the media at a periphery on opposite sides of said rotating surfaces in several parallel gaps which are formed between said rotating surfaces, said media being in rotation in said rotational direction when introduced at said periphery, each medium having a flow which is adapted to maximize heat transfer causing a major portion of the flowing media to pass through a rotating boundary layer adjacent said rotating surfaces, and then causing said media to leave the gaps at said periphery of said rotating surfaces.

2. A method according to claim 1 comprising causing said rotating surfaces to rotate at mutually the same speed.

3. A method according to claim 2 comprising adjusting the speed of said rotating surfaces so as to control the heat transfer between said media.

4. A method according to claim 3 comprising introducing said media into gaps defined between rotating disc surfaces.

5. A method according to claim 2 comprising introducing said media into gaps defined between rotating disc surfaces.

6. A method according to claim 2 wherein when effecting a transfer between several media, the media are conducted in counter-flow to one another in adjacent gaps.

7. A method according to claim 1 comprising adjusting the speed of said rotating surfaces so as to control the heat transfer between said media.

8. A method according to claim 7 comprising introducing said media into gaps defined between rotating disc surfaces.

9. A method according to claim 5 comprising driving several rotating surfaces at mutually different speeds.

10. A method according to claim 9 wherein when effecting a transfer between several media, the media are conducted in counter-flow to one another in adjacent gaps.

11. A method according to claim 1 comprising introducing said media into gaps defined between rotating disc surfaces.

12. A method according to claim 11 comprising driving several rotating surfaces at mutually different speeds.

13. A method according to claim 12 wherein when effecting a transfer between several media, the media are conducted in counter-flow to one another in adjacent gaps.

14. A method according to claim 11 wherein when effecting a transfer between several media, the media are conducted in counter-flow to one another in adjacent gaps.

15. A method according to claim 1 comprising driving several rotating surfaces at mutually different speeds.

16. A method according to claim 15 wherein when effecting a transfer between several media, the media are conducted in counter-flow to one another in adjacent gaps.

17. An apparatus suitable for transferring heat between at least two media, said apparatus comprising a housing, a shaft which rotates in said housing, a plurality of mutually adjacent first transfer surfaces fixed on said shaft, and inlets and outlets being adapted to deliver at least one of the media parallel to channels formed between said first transfer surfaces, said housing having an outer periphery at which are carried second transfer surfaces extending intermediate said first transfer surfaces, and said inlets and said outlets being provided at said outer periphery.

18. The apparatus according to claim 17 wherein said first and second transfer surfaces are comprised of flat discs.

* * * * *